US011282318B1

(12) United States Patent
Swierszcz

(10) Patent No.: US 11,282,318 B1
(45) Date of Patent: Mar. 22, 2022

(54) METHOD OF CONTROLLING ACCESS

(71) Applicant: Carrier Corporation, Palm Beach Gardens, FL (US)

(72) Inventor: Tomasz Swierszcz, Gdańsk (PL)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/123,241

(22) Filed: Dec. 16, 2020

(30) Foreign Application Priority Data

Sep. 4, 2020 (EP) ..... 20194555

(51) Int. Cl.
*G07C 9/25* (2020.01)
*G07C 9/00* (2020.01)

(52) U.S. Cl.
CPC ..... *G07C 9/25* (2020.01); *G07C 9/00309* (2013.01); *G07C 2009/00341* (2013.01); *G07C 2009/00365* (2013.01); *G07C 2009/00412* (2013.01); *G07C 2009/00507* (2013.01)

(58) Field of Classification Search
CPC ..... G07C 9/25; G07C 9/00309; G07C 2009/00341; G07C 2009/00365; G07C 2009/00412; G07C 2009/00507
See application file for complete search history.

(56) References Cited

U.S. PATENT DOCUMENTS

2008/0086758 A1 4/2008 Chowdhury et al.
2016/0217631 A1* 7/2016 Petricoin, Jr. ..... G07C 9/20
2017/0046896 A1* 2/2017 Schroader ..... G07C 9/38
2017/0132864 A1 5/2017 Adam et al.

FOREIGN PATENT DOCUMENTS

WO 2018160407 A1 9/2018

OTHER PUBLICATIONS

European Search Report for application EP 20194555, dated Feb. 25, 2021, 12 pages.

* cited by examiner

*Primary Examiner* — Nabil H Syed
(74) *Attorney, Agent, or Firm* — Cantor Colburn LLP

(57) ABSTRACT

A method of controlling access to a zone 300*a*, 300*b*, 300*c*, the zone is accessed via a first access point 301*a*, 301*b*, 301*c* having an associated first set of access rights, the first set of access rights including permission for a first entity category to access the zone 300*a*, 300*b*, 300*c*, the method including: receiving a first signal including a first identifier indicating that a first entity 302 identified by the first identifier and belonging to the first entity category is at the first access point 301*a*, 301*b*, 301*c*; in response to receipt of the first signal, allowing the first entity entry into the zone 300*a*, 300*b*, 300*c* through the first access point 301*a*, 301*b*, 301*c*; and in response to receipt of the first signal, temporarily changing the access rights associated with the first access point 301*a*, 301*b*, 301*c* to a second set of access rights.

14 Claims, 4 Drawing Sheets

METHOD OF CONTROLLING ACCESS

FOREIGN PRIORITY

This application claims priority to European Patent Application No. 20194555.7, filed Sep. 4, 2020, and all the benefits accruing therefrom under 35 U.S.C. § 119, the contents of which in its entirety are herein incorporated by reference.

TECHNICAL FIELD

The present invention relates to access control systems and methods of controlling access to a zone. The concepts disclosed herein are particularly useful in, but not limited to, situations in which persons in a zone of a building wish to avoid being followed and/or where it is desired to limit the number of people in a zone.

BACKGROUND

It is known to control access to a zone via access points. For example, it is commonplace to control access to rooms in buildings using electronic door readers that will only unlock a respective door if a user supplies the door reader with approved credentials. These credentials may be supplied to the door reader using an RFID card or similar device in the user's possession that has been configured to store the necessary approved credentials. Normally, these credentials are pre-set on the device before the device is issued to a user.

However, these systems do not take into account any proximity between multiple users having devices with approved credentials. For example, when one user accesses a zone via a particular access point, any other user having possession of a device with the approved credentials required for access via that access point may also subsequently enter the zone.

This causes particular issues in circumstances where users wish to avoid being followed into a zone, or in circumstances where it is desired to limit the number of users in a zone, regardless of whether or not other users have approved credentials for entry into the zone. This could be desired in circumstances where a higher level of security is temporarily required. Examples of where this could be applicable include banks, financial institutions or other places where valuables are transported; justice buildings, when the courtroom is vacated by judges, witnesses or convicts; and music venues when a performer uses a backstage area to exit the venue.

Furthermore, conventional systems are vulnerable to having devices with approved credentials stolen by non-authorised users or intruders who can then not only access the zone in question, but also follow users who are authorised to be in the zone. Such authorised users may be high value persons such as those in the situations described above, to whom an intruder may pose a serious risk.

SUMMARY

According to one aspect of the present invention there is provided a method of controlling access to a zone, wherein the zone is accessed via a first access point having an associated first set of access rights, the first set of access rights including permission for a first entity category to access the zone, the method comprising: receiving a first signal including a first identifier indicating that a first entity identified by a first identifier and belonging to the first entity category is at the first access point; in response to receipt of the first signal, allowing the first entity entry into the zone through the first access point; and in response to receipt of the first signal, temporarily changing the access rights associated with the first access point to a second set of access rights.

A first access controller may be associated with the first access point. Any of the access points described herein may have an associated access controller with any of the following optional features.

The first access controller may store the first set of access rights and second set of access rights. Alternatively, the first access controller may communicate with a server which stores the first set of access rights and second set of access rights.

The first access controller may receive the first signal.

The first access controller or a server may verify that the first entity belongs to the first entity category based on the first signal.

On receipt of the first signal, the first access controller may unlock the first access point to allow the first entity entry into the zone.

On receipt of the first signal, the first access controller may communicate receipt of the first signal to the server, and the server may instruct the first access controller to unlock the first access point to allow the first entity entry into the zone.

The first access point may close and lock behind the first entity and this closing and locking may be performed automatically.

The first signal may be sent by a device in the possession of the first entity. The device may be a mobile telephone, a smart card or a smart badge, for example. The device may send the first signal via near field communication (NFC), RFID, Bluetooth, or Wi-Fi, for example.

The first access point may be a door fitted with an electromechanical lock. The first access controller may be an electronic door reader and this may be configured to lock and unlock the electromechanical lock.

The zone may be a section of a building, for example a room, a corridor, an elevator, or a parking garage. The building may be a bank, an office, a hotel, a retail space, an entertainment venue, a courthouse, a laboratory, a factory, or any other building where access to a certain area may need to be restricted.

The zone may alternatively be an outside area, for example, an area around an exit of a building. In this way the zone does not necessarily need to have physically defined boundaries like walls, as long as access to the zone is controlled (e.g. access into the zone being controlled via the exit of a building).

The first set of access rights may be different from the second set of access rights, as discussed below.

The first set of access rights may include permission for a second entity category to access the zone, whereas the second set of access rights deny permission for the second entity category to access the zone.

That is, a second entity in the second entity category is usually allowed access through the first access point, but, once the first signal has been received and whilst the second set of access rights are temporarily in effect, the second entity will not be allowed into the zone through the first access point. The second entity is thereby prevented from following the first entity. The method may therefore comprise refusing an entity belonging to the second entity category access via the first access point.

The first entity category may for example be VIPs and the second entity category may for example be members of the press.

The first set of access rights may include permission for a third entity category to enter into the zone through the first access point. The second set of access rights may also include permission for the third entity category to enter into the zone through the first access point. The third entity category may for example be security staff. The method may therefore comprise allowing an entity belonging to the third entity category access via the first access point.

After the first entity identified by a first identifier in the first entity category has accessed the zone, a further entity also belonging to the first entity category may attempt to access the zone. Access to the zone may be denied to the further entity in the first entity category. That is, the second set of access rights may deny permission for entities in the first category other than the first entity identified by the first identifier to enter the zone.

The second set of access rights may deny permission for all entity categories to access the zone, apart from the third entity category mentioned above. In this way, if the third entity category is for security staff, all persons other than security staff may be prevented from following the first entity.

An example of the permissions associated with access to the zone for the first and second access rights is as follows:

First set of access rights:

First entity category (e.g. VIPs): allowed

Second entity category (e.g. press): allowed

Third entity category (e.g. security staff): allowed

Second set of access rights:

First entity category (e.g. VIPs): denied

Second entity category (e.g. press): denied

Third entity category (e.g. security staff): allowed

The second set of access rights may include an emergency override for allowing any entity entry into the zone through the first access point in a state of emergency (for example, if a fire alarm has been activated).

The first entity may be identified by a first identifier and identified as belonging to the first entity category by a device in the possession of the first entity which is arranged to communicate with the first access controller. The user may own or be assigned one or more devices. The device may be a mobile telephone, badge or card. The device may be configured to store data identifying the first entity as belonging to the first entity category and this data may be included in the first signal and/or communicated to the first access controller for verifying that the first entity belongs to the first entity category. The first identifier may be a unique identifier associated with the device.

The user may be identified by a user ID associated with their device. The first identifier may comprise this user ID. Each device may have a unique device ID. The unique device ID may be fixed, i.e. not changeable.

Entities in the second and third entity categories may be identified similarly.

A device may be reconfigured to have a different entity category and may be configured to store data identifying an entity as belonging to more than one entity category. For example, a device may be reconfigured by a server with which it can communicate (as discussed in more detail below)

The method may comprise receiving an initiating signal indicating that access to the zone is to be controlled, wherein the initiating signal is required before temporarily changing the access rights associated with the first access point to a second set of access rights.

The initiating signal may be sent by the first entity, for example by using the device in the possession of the first entity mentioned above. The initiating signal may be sent by the first entity at any location and/or time. This may be performed by sending the initiating signal to an access point or a server (as discussed in more detail below). Alternatively, the initiating signal may be sent by a different entity, such as an entity in the third entity category. The initiating signal may indicate that it is desired or required for access to the zone to be controlled. In this way, the method may begin with the sending of the initiating signal.

The initiating signal may include the first identifier identifying the first entity.

The initiating signal may be sent automatically, at a predetermined time and/or based on a location or movement of the first entity.

The method may comprise reverting the access rights associated with the first access point to the first set of access rights on expiry of a predetermined period. The predetermined period may be 10 seconds, 20 seconds, 30 seconds, 1 minute, or up to 5 minutes for example.

The method may comprise reverting the access rights associated with the first access point to the first set of access rights when it is determined that the first entity has reached a predetermined location.

The method may comprise determining a location, movement and/or direction of movement of the first entity. The location, movement and/or direction of movement of the first entity may be determined by tracking the location of the device, for example by monitoring for receipt of signals from the device in the first entity's possession at other access points. Alternatively, if for example the device is a mobile telephone, the location of the first entity may be tracked using the mobile telephone's GPS data.

Reverting the access rights associated with the first access point to the first set of access rights may be carried out as soon as one out of a predetermined set of conditions is met. The set of conditions may include a first condition, which is the expiry of a predetermined period since receipt of the first signal, and a second condition, which is the first entity arriving at a predetermined location.

As well as controlling entry into a zone, exit from the zone may be similarly controlled. The zone may be exited via a second access point having an associated first set of access rights (the same first set of access rights as are associated with the first access point), the first set of access rights including permission for the first category of entity to exit the zone.

The method may comprise: receiving a second signal indicating that the first entity is at the second access point; in response to receipt of the second signal, allowing the first entity to exit the zone through the second access point; and in response to receipt of the second signal, temporarily changing the access rights associated with the second access point to a second set of access rights (the same set of second access rights as are associated with the first access point).

In response to receipt of the second signal, (which for example, may indicate that the first entity has exited the zone) the access rights associated with the first access point may be reverted to the first set of access rights.

A second zone may be accessed via the second access point. Access to this second zone may be controlled in the same way as access to the first zone, as described above. Similarly, any number of additional controlled zones may follow the second zone.

The zone may be accessed via a plurality of access points, the plurality of access points including the first access point, and each access point may have an associated first set of access rights, the first set of access rights including permission for a first category of entity to access the zone. In response to receipt of the signal indicating that the first entity belonging to the first entity category is at the first access point, the access rights associated with each of the plurality of access points may be temporarily changed to a second set of access rights. The second set of access rights may have the features discussed above in respect of the second set of access rights for the first access point.

According to a second aspect, the invention provides a server configured to control access to a zone and communicate with an access controller associated with a first access point, wherein the zone is accessed via the first access point, the first access point having an associated first set of access rights, the first set of access rights including permission for a first entity category to access the zone. The server may be configured to: receive a first signal including a first identifier indicating that a first entity identified by the first identifier and belonging to the first entity category is at the first access point; in response to receipt of the first signal, unlock the first access point; and in response to receipt of the first signal, temporarily change the access rights associated with the first access point to a second set of access rights.

The server may be configured to communicate with a plurality of access controllers, each associated with an access point.

The server may be configured to carry out any of the method steps set out above. That is, the server may control the access controller(s) to operate according to the method outlined above.

The server may communicate with any of the entities described herein and this communication may be through a device in the possession of the entity.

The present invention also provides an access system comprising a server as described above and a plurality of access controllers (for example, each access controller being associated with an access point) in communication with the server. The access system may be configured to carry out any of the method steps set out above.

In some embodiments, a server-less system carries out the method.

Therefore, a third aspect of the invention provides: an access controller configured to control access to a zone that is accessed via an access point, wherein the access point has an associated first set of access rights, the first set of access rights including permission for a first category of entity to access the zone, the access controller being configured to: receive a first signal including a first identifier indicating that a first entity identified by the first identifier and belonging to the first entity category is at the access point; in response to receipt of the first signal, unlock the access point; and in response to receipt of the first signal, temporarily change the access rights associated with the access point to a second set of access rights.

The access controller may be configured to carry out any of the method steps set out above.

A network of access controllers may also be provided, each access controller associated with a respective access point. Each access controller may have any of the features set out above. The access controllers may be configured to communicate with one another and the network may be configured to carry out any of the method steps set out above.

As will be appreciated by the foregoing discussion, embodiments of the present invention can provide an on-demand, dynamic and temporary heightened-security area. The heightened-security area can move to follow the first entity as they move through zones in a building, with each zone reverting to the usual security settings once predetermined conditions have been met.

BRIEF DESCRIPTION OF THE DRAWINGS

Certain embodiments of the present invention will now be described, by way of example only, with reference to the accompanying drawings, in which.

DETAILED DESCRIPTION

Figure 1:
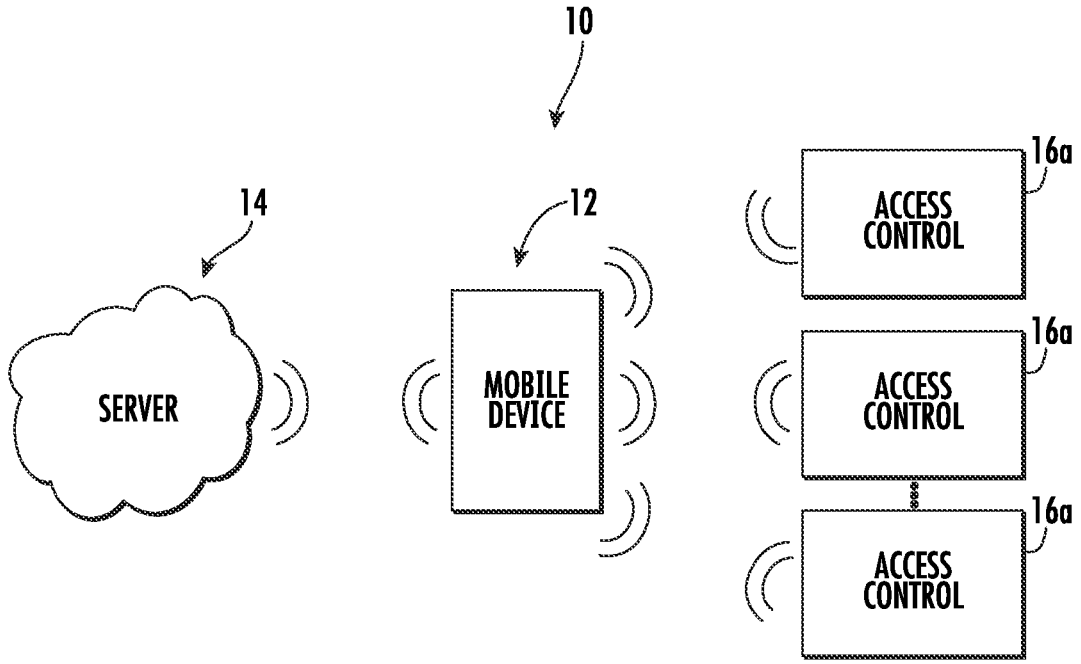
FIG. 1 is a is a schematic diagram of an access control system.

FIG. 1 schematically illustrates an access control system 10. The system 10 includes a device 12 in the possession of a user, a server 14, and a plurality of access points each having an access controller 16, schematically illustrated as 16*a*, 16*b*, . . . , 16*n*. One example of access points would be doors with electronic door readers acting as access point controllers.

It should be noted that the plurality of access controllers 16 may be configured to communicate with one another and thus form a network in place of, or in addition to the server 14. In this case, each access controller 16 can form a node of the network. Such a network may perform any or all of the functions of the server described in more detail below.

The device 12 is a wireless-capable handheld device such as a smartphone, which is operable to communicate with the server 14 and the access controllers 16 of the access points. Alternatively the device 12 could be a badge or card, e.g. an RFID smartcard. The device 12 can be configured to store credentials of particular categories and a unique identifier associated with the device. The server 14 may configure the device 12 to store credentials of particular categories and other data. For example, the server can provide one of three categories of credential to the device 12: a first category (e.g. for VIPs); a second category (e.g. for press); and a third category (e.g. for security staff). The device 12 can be reconfigured by the server 14 to store a different category of credential or a combination of categories.

Each access controller 16 is wireless-capable, such as a wireless lock or door reader for room entry. The device 12 submits credentials (of a particular category such as those described above, and including the unique identifier) to the access controllers 16, thereby selectively permitting a user to pass through the relevant access points if the credentials of the device 12 permit. A user may, for example, present a device in their possession to an access controller 16 for the device to communicate a particular category of credential stored upon the device to the access controller. In response to this, the access controller may allow the user access via an access point to an otherwise restricted room.

Figure 2:
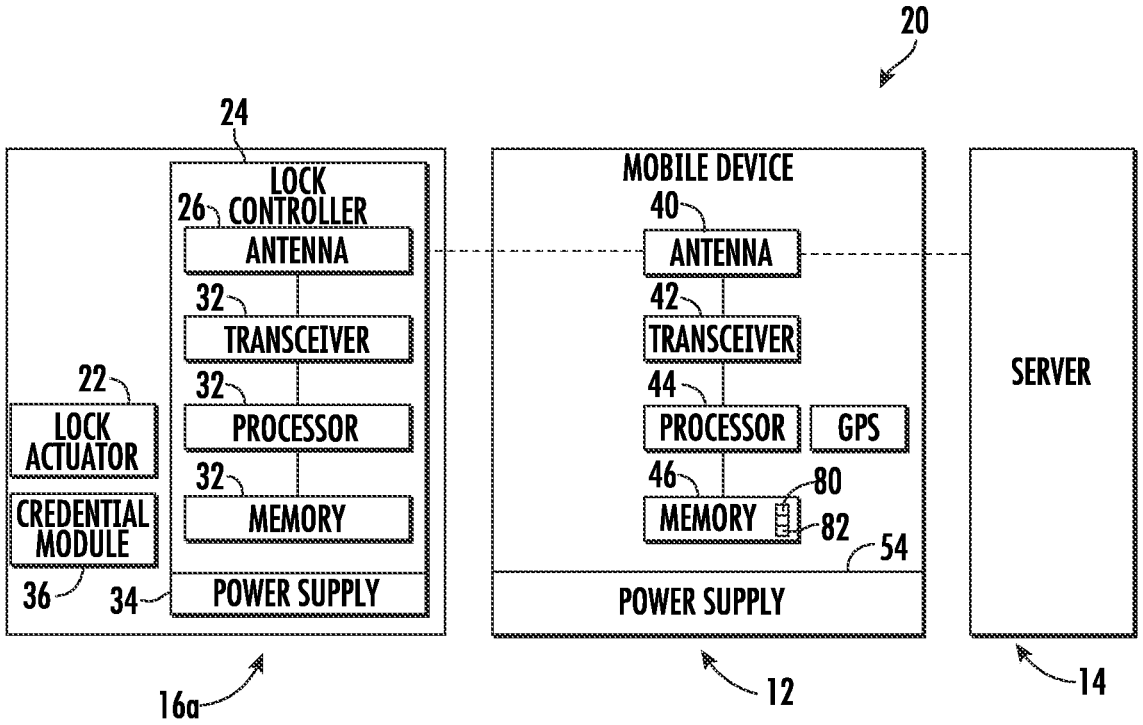
FIG. 2 is a block diagram of an access control system.

With reference to FIG. 2, a block diagram of an example electronic lock system 20 includes an access controller 16*a*, a device 12, and a server 14. The access controller 16*a* includes a lock actuator 22, a lock controller 24, a lock antenna 26, a lock transceiver 28, a lock processor 30, a lock memory 32, a lock power supply 34, and a credential module 36. The access controller 16*a* is responsive to credentials received from (and stored on) the device 12.

Upon receiving an appropriate credential category from the device 12, and validating this credential category using the credential module 36, the lock controller 24 commands the lock actuator 22 to lock or unlock a mechanical or electronic lock. The lock antenna 26 and transceiver 32 are together capable of transmitting and receiving data to and from at least the device 12 (such as the credential category); for example, via near field communication (NFC), Bluetooth, or Wi-Fi. The lock antenna 26 and transceiver 32 may also be used to communicate with the server 14 and/or other access controllers.

The device 12 includes an antenna 40, a transceiver 42, a processor 44, a memory 46, a GPS module 48, and a power supply 54. The transceiver 42 and antenna 40 are configured to communicate with those of the access controller 16*a*. The credential category of the device is stored in the memory 46 and transmitted to the access controller via the antenna 40 and transceiver 42.

In addition to the access controllers 16*a*, the transceiver 42 and the antenna 40 may also be used to communicate with the server 14. This allows the server to change the category of credential stored in the memory 46 of the device 12.

Figure 3:
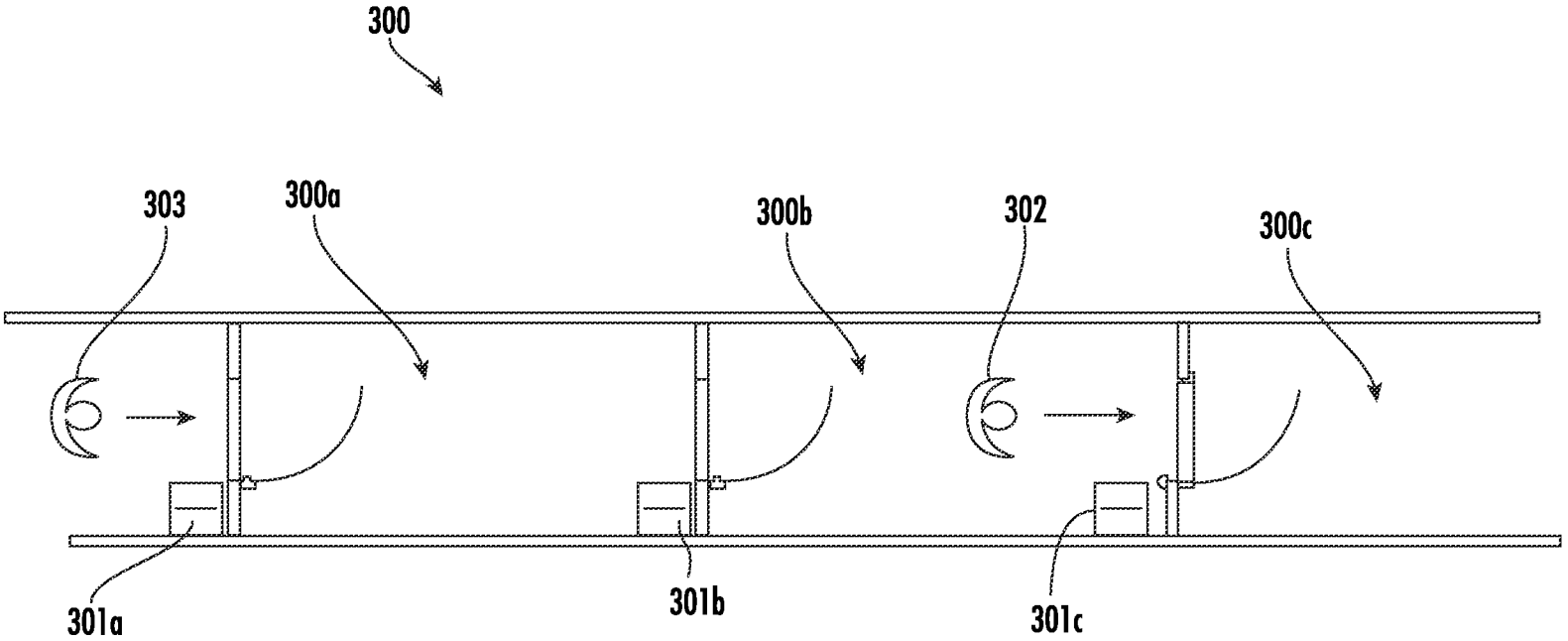
FIG. 3 is a schematic diagram of a zone in which access via access points is controlled.
Figure 4:
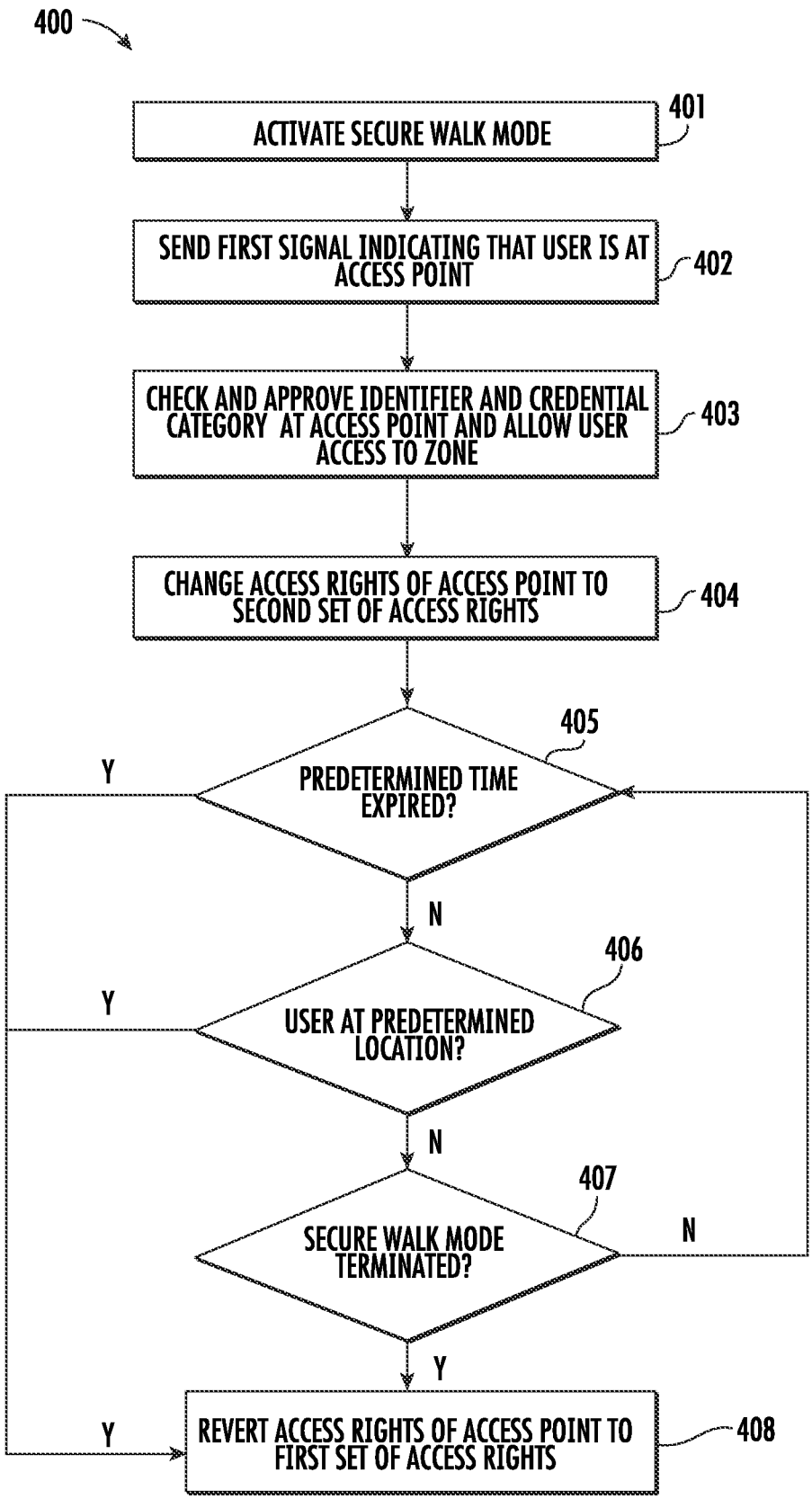
FIG. 4 is a flowchart of a method of controlling access to a zone.

With reference to FIG. 3 and FIG. 4, a method of controlling access to a zone using the above system will be described.

FIG. 3 shows a schematic diagram of a zone 300, in this case a corridor of a backstage area, in which access is controlled. The corridor 300 is divided into three sub-zones 300*a*, 300*b*, 300*c* by a series of access points having access controllers 301*a*, 301*b*, 301*c* which control access to the sub-zones.

The access controllers 300*a*, 301*b*, 301*c* comprise the access controller features described above in relation to FIGS. 1 and 2 and are integrated into respective doors in the corridor 300. Each door is locked and unlocked by the respective lock actuator 22 of the access controller 300*a*, 301*b*, 301*c* and access is controlled via this locking and unlocking.

A first user 302 is shown in FIG. 3 and this first user is in possession of a device 12 being configured with a first category of credential (first entity category) and being identified by a first identifier. In this case, the first user 302 is a VIP (e.g. a music performer) and the first category of credential is reserved for VIPs only. The first user 302 is travelling to the right in FIG. 3.

A second user 303 is also shown in FIG. 3 and this second user 303 is also in possession of a device 12. However, their device 12 is configured with only a second category of credential (second entity category). In this case, the second 303 user is a member of the press and members of the press are only assigned devices with the second category of credential.

The access controllers 300*a*, 301*b*, 301*c* each have an associated first set of access rights and an associated second set of access rights. At any one time, the access controller is only set to one particular set of access rights (as discussed in more detail below) and at times, the access rights of each access controller 300*a*, 301*b*, 301*c* can be altered.

The first set of access rights includes permissions for users in possession of a device 12 having the first category of credential or the second category of credential to open the relevant door. However, the second set of access rights denies access to users in possession of a device 12 with the first category of security credential to open the relevant door, and denies access to users in possession of a device 12 having the second category of security credential (i.e. the second user 303 in this case).

The first and second set of access rights both also include permission for a third category of credential (third entity category) to open the relevant door. This third category is reserved for security staff in this case.

The second set of access rights deny permission for all entity categories (categories of credential) to access the zone, apart from the third category of credential (third entity category) mentioned above.

The first and second set of access rights are also configured to include an emergency override for allowing any entity entry into the zone through the first access point (i.e. door) in a state of emergency (e.g. when a fire alarm has been activated).

In the event that the first user 302 does not want to be followed by a second user 303, they may activate a secure-walk mode using their device 12. For example, this may be performed by the user using an application on their mobile telephone (as an example of a device 12). The device 12 then sends an initiating signal to the server 14 indicating that the secure-walk mode has been activated and the server 14 communicates this to each of the access controllers 300*a*, 301*b*, 301*c*. In response, the access controllers are placed in a secure-walk mode. It should be noted that this does not yet change the access rights of the access controllers. The initiating signal includes a first identifier (a unique identifier associated with the device) identifying the first user 302 as the user who has initiated the secure-walk mode. Optionally, only one user at any one time may activate a secure-walk mode.

In normal use (i.e. when the secure-walk mode has not yet been enabled by the first user 302) the access controllers 300*a*, 301*b*, 301*c* are all set to the first set of access rights and these access rights are not influenced or changed by the passage of a user through the relevant access controller. However, when placed in this secure-walk mode, the access rights of the access controllers 300*a*, 301*b*, 301*c* can be influenced by the passage of the first user 302 as described below.

Once the secure-walk mode has been enabled, if the first user 302 presents their device 12 to a first access controller 301*a* in order to gain access through the relevant access point, the device 12 sends a first signal including the first identifier and the first category of security credential to the access controller 301*a*, indicating that the first user 302 is at the relevant access point. The access controller 301*a* then checks and approves the credential category before unlocking the relevant door and allowing the first user to pass through, thus accessing a first sub-zone 300*a*. The access point closes behind the first user 302 after they have passed through, thus requiring any subsequent users to present their own device to the access controller 301*a* in order to gain access.

When in the secure-walk mode, in response to receiving the signal including the first identifier indicating that the first user 302 is at the first access point, the access controller 301*a* will switch the associated access rights to the second set of access rights for a predetermined time. The second set of access rights do not include permission for the second user 303 to pass through the first access point, thus preventing the second user 303 from following the first user 302 by passing through the first access point (during the predetermined time). In this example, the predetermined time is 30 s.

As discussed above, the second user 303 is one having a second category of credential (second entity category). However, entry to the zone for the second user 303 would also be denied if the second user 303 had the first category of credential (first entity category). Entities in the first entity category other than the first entity identified by the first identifier are denied entry to the zone, under the second set of access rights.

After the predetermined time has elapsed, the access rights of the first access controller revert back to the first set of access rights, thus allowing the second user 303 to pass through the relevant access point. However by this time, the first user 302 should have had time to exit the subzone 300*a* and so they cannot be followed.

It is important that the access rights are only changed to the second set of access rights temporarily in order to limit the detrimental effect this has on the movement of other users in the corridor.

Alternatively, or in addition to the use of a predetermined time, the access rights of the first access controller 301*a* may revert back to the first set of access rights based on the first user 302 reaching a predetermined location. For example, when it is known that the user has left the relevant sub-zone 300*a*. This could be determined by the server 14 when the first user 302 reaches another access point having an access controller 301*b*, 301*c* or by the server 14 monitoring a GPS location of the device 12 of the first user 302 and, using geofencing, establishing when the user has left the sub-zone 300*a*.

The first user 302 may also end the secure-walk mode using their device 12, for example using the application on their mobile telephone described earlier. The device 12 then sends a terminating signal to the server 14 indicating that the secure-walk mode has been de-activated and the server 14 communicates this to each of the access controllers 300*a*, 301*b*, 301*c*. In response, the access controllers 300*a*, 301*b*, 301*c* are removed from the secure-walk mode and placed in a normal mode, reverting back to the first set of access rights.

The sub-zone 300*a* may be accessed via a plurality of access points each having access controllers, for example via additional, similar doors from rooms along the corridor (not shown). In response to receiving the signal indicating that the first user 302 is at the first access point, each of the plurality of access controllers may switch the associated access rights to the second set of access rights for a predetermined time, thus preventing another user with the second category of credential (or in fact any category of credential other than the third category) from passing through any of the other access points within the predetermined time. In effect, this restricts access to the entire sub-zone 300*a*. This prevents the first user from not only being followed, but also being intercepted in the zone via a different access point into the zone.

Once the first user 302 has passed through the first access point and the first sub-zone 300*a* they may perform a similar process at a second access point having a second access controller 301*b* to access a second sub-zone 300*b*. A similar method is followed to that described above, thus changing the access rights of the second access controller 301*b* to the second set of access rights and restricting access to the second sub-zone 300*b*. The same applies to subsequent access points having access controllers 301*c* as long as the secure-walk mode is enabled. Thus, the same method can be applied for a number, or series of other zones. In this manner, the zone in which access is restricted can in essence follow the first user 302 through the corridor 300. As such, the overall zone in which access is controlled can be thought of as being dynamic, comprising a selection of a number of predetermined sub-zones 300*a*, 300*b*, 300*c*; the selection depending on the location and/or movement of the first user 302. Thus, the overall zone has no fixed borders and instead follows the first user.

A flowchart of a method 400 of controlling access to a zone via an access point having an access controller 16, 301 is shown in FIG. 4. The method is similar to that described above in relation to FIG. 3. The method begins at step 401, with the user activating a secure-walk mode using their device 12. The device 12 sends an initiating signal to the server 14 indicating that the secure-walk mode has been activated and the server 14 communicates this to each of the access controllers 16, 301. In response, the access controllers 16, 301 are placed in a secure-walk mode.

When the user approaches an access point having an access controller 16, 301 and presents their device 12 to the access controller, the method proceeds to step 402 in which the device 12 sends a first signal including the first identifier and stored first credential category to the access controller 16, 301. This first signal indicates that the user is at the access point.

At step 403, the access controller checks the identifier and credential category and, if the category is associated with permission to unlock the door, approves the credential category before unlocking a respective door and allowing the user to pass through. The access controller 16, 301 closes behind the user after they have passed through, thus requiring any subsequent users to present their own device 12 to the access controller 16, 301 in order to gain access. At step 404, in response to receiving the first signal including the first identifier from the device 12 indicating that the user is at the access point, the access controller will also switch the associated access rights to the second set of access rights, thus restricting access as previously described.

The time that has elapsed from the moment at which the first signal is received at the access controller 16, 301 is monitored and at step 405 it is determined whether or not a predetermined time (e.g. 30*s*) has expired. If so, the method proceeds to step 408 and the access rights of the first access controller revert back to the first set of access rights. If the predetermined time has not expired the method proceeds to step 406.

In step 406, it is determined whether or not the user has reached a predetermined location. If the user has reached a predetermined location the method proceeds to step 408 and the access rights of the first access controller revert back to the first set of access rights. As discussed previously in relation to FIG. 3, this may occur when it is known that the user has left the relevant sub-zone 300*a*, 300*b*, 300*c*. This could be determined by the server 14 when the first user 302 reaches another access point having an access controller 16, 301 or alternatively, the server 14 could monitor a GPS location of the device 12 and, using geofencing, establishing when the user has left the relevant sub-zone 300*a*, 300*b*, 300*c*.

If the user has not reached a predetermined location the method proceeds to step 407, where it is checked whether or not the user has terminated the secure-walk mode using the device 12. If so, the method proceeds to step 408 and the access rights of the first access controller revert back to the first set of access rights. If not, the method returns to step 405 to check once again whether the predetermined time has expired. This cycle of steps 405 to 407 continues until one of the conditions is met (e.g., the user is at a predetermined location or the secure walk mode has been terminated by the user) and the method ends at step 408.

In some embodiments, steps 406 and 407 may be omitted, such that the access rights revert from the first set of access rights to the second set of access rights simply on expiry of the predetermined time.

What is claimed is:

1. A method of controlling access to a zone, wherein the zone is accessed via a first access point having an associated first set of access rights, the first set of access rights including permission for a first entity category to access the zone, the method comprising:

receiving a first signal including a first identifier indicating that a first entity identified by the first identifier and belonging to the first entity category is at the first access point;

in response to receipt of the first signal, allowing the first entity entry into the zone through the first access point; and in response to receipt of the first signal, temporarily changing the access rights associated with the first access point to a second set of access rights; and reverting the access rights associated with the first access point to the first set of access rights on expiry of a predetermined time period since receipt of the first signal;

wherein the first set of access rights include permission for a second entity category to access the zone, and the second set of access rights deny permission for the second entity category to access the zone.

2. A method of controlling access to a zone as claimed in claim 1, wherein the second set of access rights include permission for a third entity category to access the zone through the first access point and/or an emergency override for allowing any entity entry into the zone through the first access point in a state of emergency.

3. A method of controlling access to a zone as claimed in claim 1, wherein the second set of access rights deny permission for other entities in the first entity category to access the zone.

4. A method of controlling access to a zone as claimed in claim 1, wherein the first entity is identified by the first identifier and identified as belonging to the first entity category by a device in the possession of the first entity which is arranged to communicate with the first access point.

5. A method of controlling access to a zone as claimed in claim 1, wherein the method comprises:

receiving an initiating signal indicating a desire to control access to the zone, the initiating signal including the first identifier, wherein the initiating signal is required before temporarily changing the access rights associated with the first access point to a second set of access rights.

6. A method of controlling access to a zone as claimed in claim 1, wherein the method comprises reverting the access rights associated with the first access point to the first set of access rights when it is determined that the first entity has reached a predetermined location.

7. A method of controlling access to a zone as claimed in claim 1, wherein the zone is exited via a second access point having an associated first set of access rights, the first set of access rights including permission for the first category of entity to exit the zone, the method comprising:

receiving a second signal including the first identifier indicating that the first entity identified by the first identifier is at the second access point;

in response to receipt of the second signal, allowing the first entity to exit the zone through the second access point;

in response to receipt of the second signal, temporarily changing the access rights associated with the second access point to a second set of access rights.

8. A method of controlling access to a zone as claimed in claim 7, the method comprising:

in response to receipt of the second signal, reverting the access rights associated with the first access point to the first set of access rights.

9. A method of controlling access to a zone as claimed in claim 7, wherein a second zone is accessed via the second access point and the method comprises controlling access to the second zone.

10. A method of controlling access to a zone as claimed in claim 1, wherein the zone is accessed via a plurality of access points, the plurality of access points including the first access point, wherein each access point has an associated first set of access rights, the first set of access rights including permission for a first entity category to access the zone, the method comprising:

in response to receipt of the signal including a first identifier indicating that a first entity identified by the first identifier and belonging to the first entity category is at the first access point, temporarily changing the access rights associated with each of the plurality of access points to a second set of access rights.

11. A method of controlling access to a zone as claimed in claim 1, wherein the first access point is a door fitted with an electromechanical lock and/or the zone comprises an area of a building.

12. A server configured to control access to a zone and communicate with a first access controller associated with a first access point, wherein the zone is accessed via the first access point, the first access point having an associated first set of access rights, the first set of access rights including permission for a first entity category to access the zone, the server being configured to:

receive a first signal including a first identifier indicating that a first entity identified by the first identifier and belonging to the first entity category is at the first access point;

in response to receipt of the first signal, unlock the first access point; and in response to receipt of the first signal, temporarily change the access rights associated with the first access point to a second set of access rights; and reverting the access rights associated with the first access point to the first set of access rights on expiry of a predetermined time period since receipt of the first signal;

wherein the first set of access rights include permission for a second entity category to access the zone, and the second set of access rights deny permission for the second entity category to access the zone.

13. An access controller configured to control access to a zone that is accessed via an access point, wherein the access point has an associated first set of access rights, the first set of access rights including permission for a first category of entity to access the zone, the access controller being configured to:

receive a first signal including a first identifier indicating that a first entity identified by the first identifier and belonging to the first entity category is at the access point;

in response to receipt of the first signal, unlock the first access point; and in response to receipt of the first signal, temporarily change the access rights associated with the access point to a second set of access rights; and reverting the access rights associated with the first access point to the first set of access rights on expiry of a predetermined time period since receipt of the first signal;

wherein the first set of access rights include permission for a second entity category to access the zone, and the second set of access rights deny permission for the second entity category to access the zone.

14. A network comprising a plurality of access controllers, the plurality of access controllers each being access controllers as claimed in claim 13, wherein the plurality of access controllers are configured to communicate with one another.

* * * * *